United States Patent [19]

Pfeuffer et al.

[11] Patent Number: 4,744,321

[45] Date of Patent: May 17, 1988

[54] SHIP FOR THE LIQUID TRANSPORTATION OF HIGH MELTING AROMATIC HYDROCARBONS

[75] Inventors: Michael Pfeuffer, Krefeld; Arnold Alscher, Essen, both of Fed. Rep. of Germany

[73] Assignee: Verkaufsgesellschaft fuer Teererzeugnisse (VfT), Duisburg, Fed. Rep. of Germany

[21] Appl. No.: 28,933

[22] Filed: Mar. 23, 1987

[30] Foreign Application Priority Data

Apr. 9, 1986 [DE] Fed. Rep. of Germany ..... 3611920

[51] Int. Cl.[4] ..... B63B 25/08

[52] U.S. Cl. ..... 114/74 A

[58] Field of Search ..... 114/74 R, 74 A, 73; 220/901

[56] References Cited

U.S. PATENT DOCUMENTS 2,738,749 3/1956 Macy et al. ..... 114/73

3,064,612 11/1962 Gardner et al. ..... 114/74 A 3,147,728 9/1964 Ishii et al. ..... 114/74 R 3,428,205 2/1969 Basile et al. ..... 114/74 A

*Primary Examiner*—Joseph F. Peters, Jr.

*Assistant Examiner*—Jesûs D. Sotelo

*Attorney, Agent, or Firm*—Beveridge, DeGrandi & Weilacher

[57] ABSTRACT

A double hull ship for the transportation of liquid, high melting aromatic hydrocarbons, such as pitch heated to 200° to 300° C. The tanks are provided with good insulation and with means to introduce inert gas into the tank (1). Heat expansion is allowed for by means of companion expansion joints and sliding bearings (3). Because of the high solidification point of the products, all line systems must be provided with a companion heating system and adequate insulation. A thermal oil system, which simultaneously supplies the emergency heating system (4) of the tank (1), is suitable for this purpose. Separate ballast tanks (17) are installed between the hulls.

12 Claims, 2 Drawing Sheets

SHIP FOR THE LIQUID TRANSPORTATION OF HIGH MELTING AROMATIC HYDROCARBONS

Figure 1:
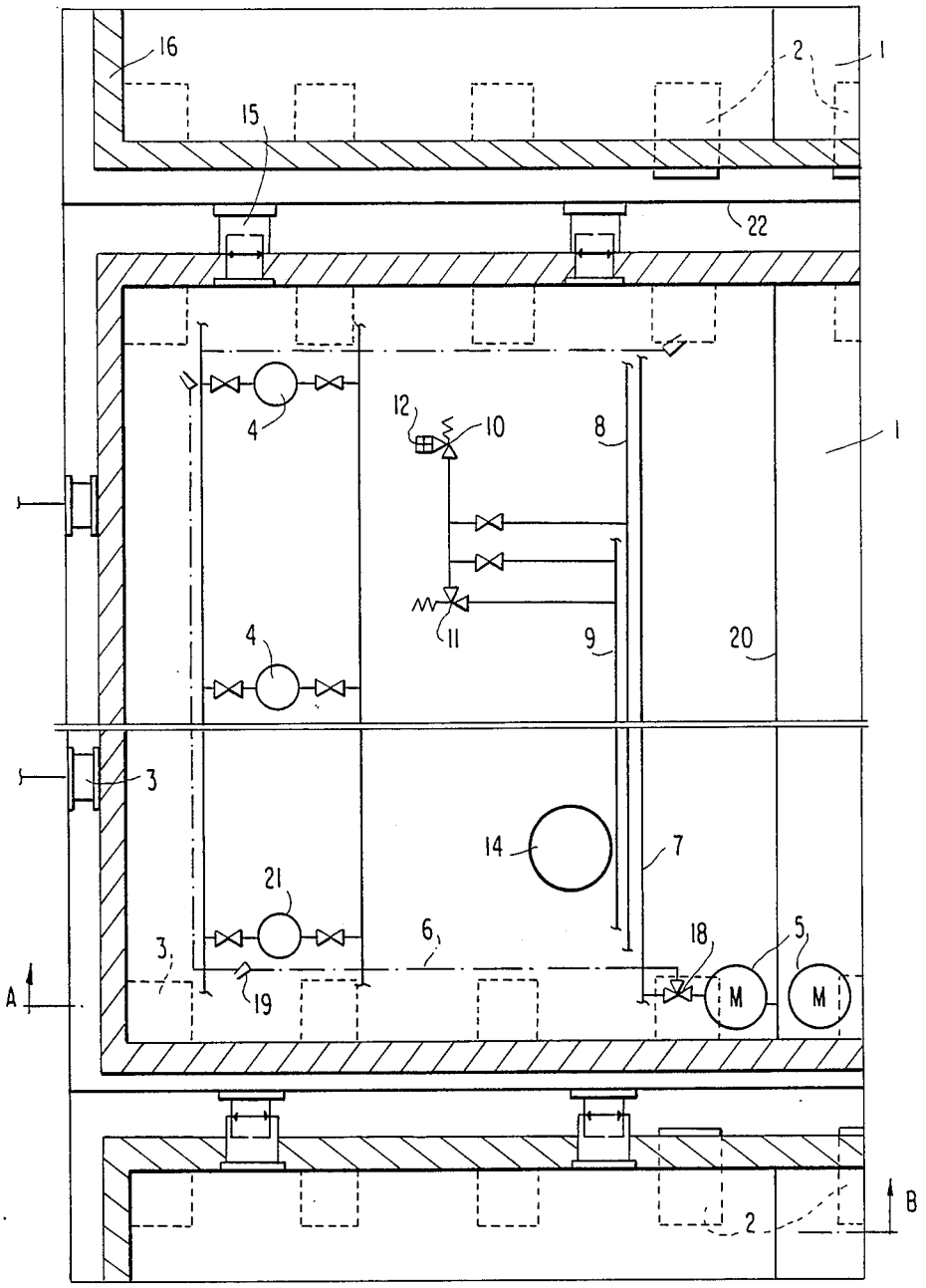

The present invention relates to a ship for the transportation of liquid, high melting aromatic hydrocarbons at a temperature of at least 100° K. above the melting point. In particular, the present invention relates to the transporation of liquid bituminous coal tar pitches, and also for the transportation of fractions with a high solidification point, such as fluoranthene fractions (above 90° C.) and pyrene fractions (above 110° C.), and the like.

Special purpose ships for the transportation of flammable liquids are known in the art. In addition to crude oil tankers with single hulls, there are liquefied gas ships with insulated three-shell spherical tanks and expensive safety devices. These ships transport the flammable liquids, either at ambient temperature or at lower temperatures which, in the case of liquefied natural gas (LNG), for example, lie in the region of −165° C. The liquids are generally free of sediments, and their properties do not change during transportation. Heated tanker ships with double hull construction for the transportation of liquid bitumen are also known. In the case of bitumen, the temperature range in which it is readily pumpable varies, depending on variety; that is:

between 67° and 90° C., for cutback bitumen, between 105° and 135° C., for distilled bitumen, and between 165° and 200° C., for blown bitumen.

In general, ships for carrying bitumen are built having these temperature ranges in mind. Normally, however, the temperature of the transported bitumen is no higher than 180° C. Since bitumens contain only approximately up to 0.5 weight percent of solids, the watertight tank compartments are provided with a bottom heating system. Because of the double hull construction of the ship, direct cooling of the outside walls of the tank compartment by the seawater is avoided. Further insulation is not provided for and the heat losses are compensated for by the bottom heating system. Since the bitumen is used only in the construction industry, the slight changes in properties due to the heating and the contact with air are unimportant, within the given temperature ranges and during the relatively short time of action. Therefore, the bitumen ships have tank compartments which are open to the atmosphere. Of course, this facilitates the loading and unloading of the freight. The liquid level can, for example, be measured with a measuring stick from a manhole located on the deck. The filling and emptying of the tank compartments is carried out with pumps located in an external pump room in the hull of the ship. Since refineries are primarily located in the coastal area, only ocean going vessels are built for bitumen transportation. Seagoing ships which have such a shallow draft that they can also navigate the larger inland waterways are known only for the transportation of mixed cargo.

The requirmenets that are necessary in the design of ships for the transportation of liquid, high melting aromatic hydrocarbons, such as bituminous coal tar pitch, for example, differ considerably from the design prerequisites for ships carrying bitumen. For example, in addition to the fact that tar refineries are more frequently located in the interior of the country instead of being located exclusively on the coastal regions, the properties of pitch and its ultimate use are to be taken into consideration. Thus, hard pitches have softening points of above 150° C. (Kraemer-Sarnow). At a softening point of around 100° C., electrode pitches contain up to 19 weight percent of quinoline insoluble constituents and a correspondingly high solids fraction. They are most reactive to oxygen and are also temperature sensitive. Therefore, the formation of chemical compounds with higher molecular weights, characterized, for example, by an increasing content of toluene insolubles, can already begin at temperatures below 350° C. However, these newly formed compounds alter the viscosity and wetting behavior of electrode pitches to an undesirable extent. Moreover, because of the health endangering effect of aromatic vapors, special safety precautions are necessary.

None of the ships heretofor used for the transportation of liquid cargo satisfy all of the necessary measures required for the transportation of, for example, liquid pitch.

Therefore, the need existed in this art to develop means for transporting high melting aromatic hydrocarbons in the form of a ship which is designed to meet the special requirements for these substances.

In accordance with the foregoing, a feature of the present invention resides in a double hull ship comprising a plurality of centrally located, fully insulated holding tanks, each of which is permanently fixed to the ship's hull, preferably, at a point in the center of the tank wall facing toward the bow or stern. These tanks are generally guided or supported by sliding bearings. Associated with each tank is at least one heat exchanger that is typically introduced from above into each tank, and which is heatable with thermal oil. The exchanger has substantially vertical heat exchange surfaces and can be controlled by a temperature sensor. Each tank is also fitted with at least one submersible pump that is introduced from above and to which are connected a flushing line and a product line for the filling and emptying of the tank.

A pendant flexible gas line can also be connected to the tank, as may be desired. An inert gas line can be connected to each tank for injecting inert gas into the particular tank concerned under the control of a pressure switch.

At least one safety valve for overpressure and underpressure can be provided with a flametrap at the overpressure outlet and inert gas supply connection at the underpressure opening. In each of the tanks, there is located at least one non-mechanical level meter. A safety system is also preferably included to trigger an alarm at a filling level of 96 to 98%.

The system also includes a companion heating system for all product and gas lines including the flanges, control and shutoff devices; and a heated, insulated manhole on each tank compartment.

Figure 2:
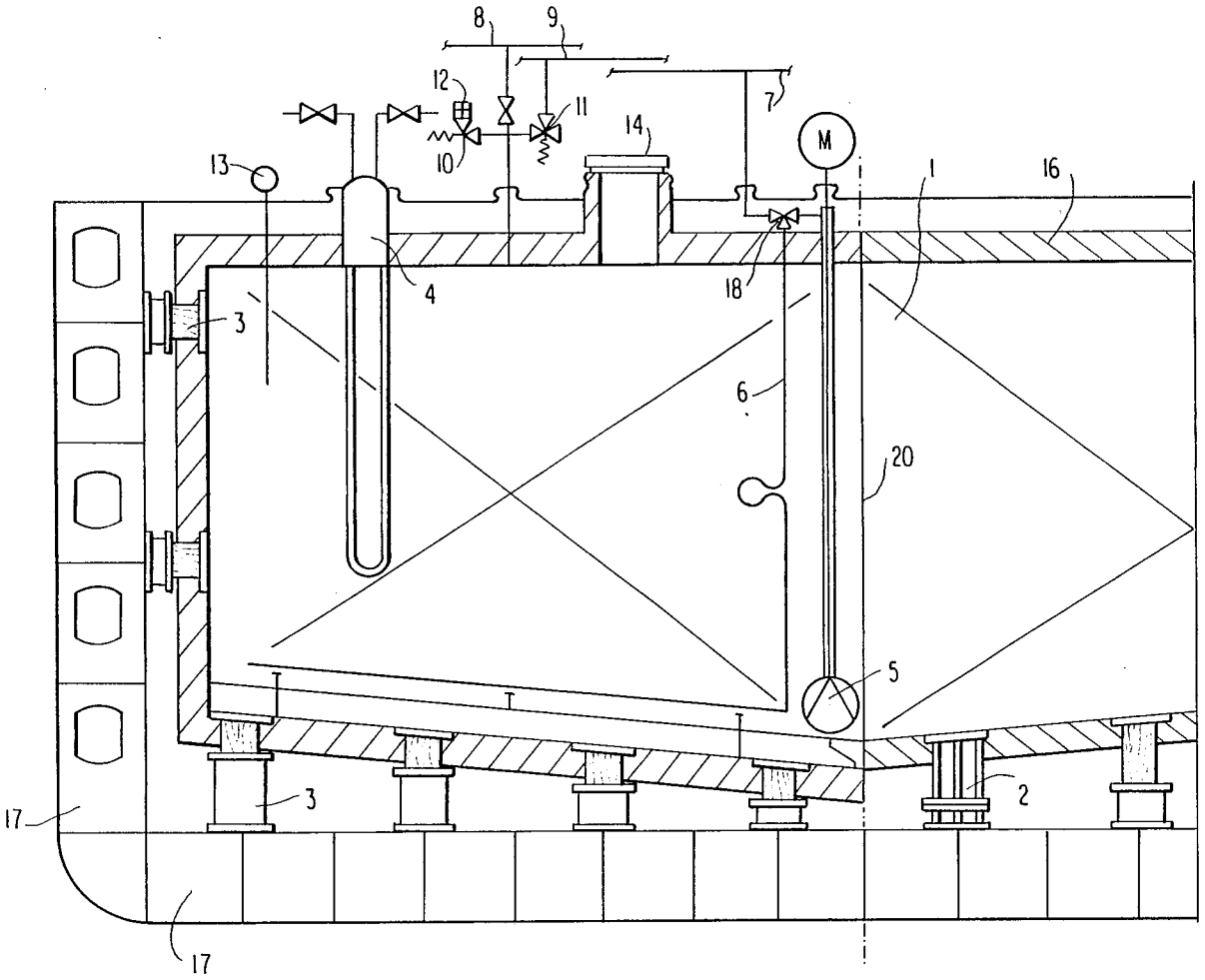

The invention will be further understood with reference to the accompanying drawings, wherein:

FIG. 1 is a cross-sectional view of the ship without the outer hull, deck and upper tank insulation, showing the tank arrangement of the present invention; and FIG. 2 is a cross-sectional elevational view taken along the section lines A-B in FIG. 1 and shows a partial view of the tank configuration of the invention.

Described in further detail with reference to FIGS. 1 and 2, the present invention relates to a double hull ship comprising:

(a) centrally installed, fully insulated tanks (1), each of which is permanently fixed—at a point (2) especially in the center of the tank wall oriented toward the bow or stern—to the ship's hull and are guided or supported by sliding bearings (3);

(b) at least one exchanger (4) introduced from above into each tank, heatable with thermal oil, having substantially vertical heat exchange surfaces and controlled by a temperature sensor;

(c) at least one submersible pump (5), introduced from above into each tank, to which are connected both the flushing line (6) and the product line (7) for the filling and emptying of the tank;

(d) a pendant flexible gas line (8) that can be connected to the tank, as required;

(e) an inert gas line (9) connected to each tank, as required, for injecting inert gas into the particular tank concerned under the control of a pressure switch;

(f) at least one safety valve (10, 11) for overpressure and underpressure, with a flametrap (12) at the overpressure outlet and an inert gas supply line connection at the underpressure opening;

(g) in each of the tanks, at least one non-mechanical level meter (13) and a safety system for triggering an alarm when the filling level reaches about 96 to 98%;

(h) a companion heating system for all product and gas lines including the flanges, control and shutoff devices; and (i) a heated, insulated manhole (14) on each tank compartment.

During operational navigation in an empty or unloaded condition, the ship cannot have ballast water in the tanks, because even small quantities of water lead to enormous foaming during filling with the hot liquid hydrocarbons. Therefore, additional ballast tanks (17) must be installed between the inner and outer hull of the ship.

The hydrocarbon holding tanks (1) are filled with hydrocarbons at a temperature between 180° and 300° C., preferably 220° to 260° C. In the process, the tank's walls expand by about 3.8 mm per meter. In order to avoid stresses in the ship's hull and tank walls that, under certain circumstances, could lead to leaks, the tanks rest on sliding bearings, preferably of lignum vitae or other water resistant, thermally insulating bearing material with sufficient heat resistance, and are laterally guided with such bearings. In order to achieve good lateral guidance, it is advisable to equip these bearings with spring elements such as cup springs or pneumatic springs. A transverse bulkhead (22) is placed between the tanks, so that the individual tank compartments are partitioned off by transverse watertight bulkheads. In order to be able to detect immediately any kind of leak or fire, a temperature sensor can be possible to extinguish any fire by internal means in each compartment, e.g., with $CO_2$. The individual tank compartments must also be of the walk-in type, either through manholes from the ballast tanks on the starboard or port sides or through manholes with direct access from the open deck. Pneumatic or hydraulic dampers (15) with gas springs can be installed between the transverse bulkhead (22) and the neighboring tank wall which is not fixed so that, in the event of violent movement and partly filled tanks, the inertial forces are transmitted relatively uniformly to the ship's hull. Preferably, the tank bottom has a slope of 3° to 5° toward a corner in which a tank sump is installed, if necessary.

The tank insulation consists of inorganic insulating material such as rock wool, cellular glass and the like. Insulating matting of rock or slag wool in particular are provided for the pipelines. The insulations are to be provided externally with a lining in order to prevent permeation with moisture. The thickness of the tank insulation is to be dimensioned such that the average temperature drop in the tank, at a mean temperature of 250° C., is not more than 10° K./day, preferably less than 5° K./day.

In order to allow for thermal expansion, all tank connections, where they penetrate the deck, are connected to the deck by means of thin walled corrugated tube (metal bellows). Also, all pipes are provided with expansion joints, which can absorb the thermal expansion.

The indirect heating of the tanks with thermal oil is controlled by means of conventional temperature sensors, while the heating of the complete pipelines can, if necessary, be turned on manually.

Preferably, a thermally stable oil compatible with aromatics, is used as the thermal oil, so that no flocculation can occur in the event of leaks. A methylnaphthalene oil is especially suitable for this purpose.

The submersible pump must be suitable for high melting solids-rich liquids, i.e., it must not contain valves and must start slowly, in order that the drive shaft not be sheared off at low temperatures. Suitable are thyristor-controlled, positive displacement pumps with overflow valve in the bypass, such as, for example, rotary piston pumps or vane pumps, especially Viking pumps or screw pumps, or even centrifugal pumps with back shroud blading to prevent cavitation and with smooth casing without guide means. On the pressure side of the submersible pump (5), there is connected a three-way cock (18), which connects the pressure side, as required, with the flushing line or with the line for emptying or filling the tank. At the lowest point of the tank, in the corners remote from the suction side of the pump, the flushing line is provided with outlet openings, preferably nozzles (19), which are oriented such that no solids can be deposited in the corners of the tank and the tank contents are moved in a rotating flow. During filling of the tank and with the pump turned off, the product is forced through the three-way cock directly into the flushing line. It is, of course, also possible to install a separate filling line directly to the tank bottom.

Mechanical measuring devices, such as for example, floats, are less suitable for measuring the liquid level, since the tank is to be sealed against atmospheric oxygen and, moreover, because encrustations would tend to form on the float due to the high melting point of the aromatics. Therefore, non-mechanical measuring devices are used, such as, for example, temperature resistant capacitive or inductive level meters. Liquid level measurement by absorption of weakly radioactive radiation (gamma emitters) has also proven to be successful. Float controlled electrical switches can also be used for the safety system that triggers an alarm against overfilling of the tank.

It is of utmost importance to render the tank inert. The tendency of aromatic mixtures, especially of pitches, to oxidize in the indicated temperature range is known. Unlike on-shore tanks, for which surface renewal in general is hardly a concern—if the worst comes to the worst, a slight thermosiphon flow can occur in heated tanks due to heat convection—with the tanks of the invention the surface is constantly being renewed by continuous recirculation and by the natural motion of the ship. Particularly in the case of electrode and waterproofing pitches, the viscosity change caused by oxidation leads to difficulties during processing and deleteriously affects the wetting and filtration behavior of the pitches. Therefore, the tanks must be carefully rendered inert with a non-oxidizing gas, preferably with nitrogen, and air ingress must be prevented. This is achieved with a pendant flexible gas line, which connects the tanks during the filling and emptying operations with the on-shore tanks, which are also rendered inert. The tanks are also connected by means of an inert gas line with an inert gas generator, such as, for example, a nitrogen generator, which continuously provides for a controlled slight overpressure of inert gas in the tanks. In this way, air ingress is prevented even in the event of certain leaks on flanges or on the manhole closure member.

By means of partitions, the tanks can be divided in the longitudinal direction of the ship into several, preferably two, compartments which are simultaneously filled or emptied, in order to prevent thermal stresses.

In greater detail, the completely insulated tank (1) is divided at midship by the wall (20) into two tank compartments. Between the tanks (1) is located a transverse watertight bulkhead (22). Because of the supports (2), the tank is permanently connected to the ship's hull. Sliding bearings (3) prop up the tank (1) and give it lateral guidance. They consist of steel brackets which are connected to the ship's hull and on which the lignum vitae blocks, connected to the tank (1) and jutting out of the insulation (16), can move. Between the transverse bulkhead (22) and the end wall of the tank (1), which is not fixed, are located hydraulic dampers (15) with gas springs. Flanged to the tank tops are heat exchangers (4) having vertically arranged heat exchange surfaces that extend deep into the tanks (1). By means of valves that can be operated both manually and, if desired, controlled by a temperature sensor (not shown), they are connected in parallel with the thermal oil circuit (21). Thus, individual heat exchangers can be introduced without the need to interrupt the thermal oil circulation. It is also possible to use two manually operated shutoff devices and one temperature controlled device for each heat exchanger.

The tank bottom is sloped diagonally by approximately 3° to 5° from an outer corner toward the center. The suction connection of the submersible pump (5) is seated at the lowest point of the sump, which is preferably heated. The drive shaft and the pressure connection are brought out of the tank (1) connected to the tank top by means of a flange. The enclosed thyristor controlled motor is located above deck. The submersible pump (5) is introduced from above into a mount (not shown) located in the tank (5). By means of a three-way cock (18), the pressure connection of the pump (5), the flushing line (6) and the product line (7) for filling and emptying are connected to each other. During navigation, the product is recirculated through the flushing line (6), which is provided with nozzles (19) directed toward the corners. During emptying, the cock is repositioned and the pressure connection is connected to the product line (7) and, during filling, the product line (7) is connected to the flushing line (6). When pumping with reversible direction of delivery, filling by means of the pressure connections is also possible. The flushing line (6) is fixed to the bottom by means of forked mounts.

The filling and emptying operation is monitored by means of a non-mechanically functioning level meter (13). In addition, the tanks (1) are connected via a pendant flexible gas line (8) with the particular inertized on-shore tank concerned so that the inert gases—under certain circumstances saturated with aromatic vapors—are not exhausted to the atmosphere or do not have to be burned by means of a flare, so the inert gas consumption can be kept to a bare minimum. Furthermore, the tank is connected to an inert gas line (9), if relatively large quantities of inert gas are needed in the event of a sudden pressure drop. The same or a different tank connection is provided with an overpressure (1) and an underpressure safety valve (11). The overpressure safety valve (10) is provided with a flametrap (12). The underpressure safety valve (11) is connected to the inert gas line (9). For inspection and repair purposes, each tank compartment has at least one insulated manhole (14), which is guided through the deck. In order to ensure the necessary stability during unloaded navigation, the ship is equipped with ballast tanks (17) between the two hulls.

If the ships are also to navigate inland waters, they must have only a relatively shallow draft and must comply with the regulations for inland navigation, such as those which correspond approximately to the ADNR regulations for navigation on the Rhine River in Europe.

With regard to outfitting, the ships must comply with the safety regulations for K1 ships.

All line systems, including the gas lines, have a companion heating system, with thermal oil, for example, and are well insulated.

Unlike crude oil tankers, the tanks described in the present invention cannot be cleaned with water but only with solvents for hydrocarbons. Good pitch solvents, such as, for example, anthracene oil, which preferably are heated to around 80° C., are especially suitable for this purpose. The tank to be cleaned is partly filled with the solvent, which is delivered by means of the submersible pump (5) to one or more rotating wash cannons, which are lowered from the deck into the manholes. The solvent is circulated throughout the entire washing process. Thereafter, the contaminated solvent is pumped into a separate tank, from which it can be pumped out for reprocessing. In order to save tank capacity, it is advisable to clean the tank in port, where the solvent can be delivered in a tank truck and the solvent contaminated with pitch residues can be removed directly for reprocessing.

Further variations and modifications of the present invention will be apparent to those skilled in the art from the foregoing and are intended to be encompassed by the claims appended hereto.

We claim:

1. A double hull ship for the transportation of liquid, high melting aromatic hydrocarbons at temperatures of at least 100° K. above the melting point of said hydrocarbons comprising:

(a) at least one hydrocarbon holding tank (1) centrally located with respect to the side walls of said hull, said tank being provided with insulation, said tank being permanently fixed to the ship's hull, said tank being supported by a plurality of sliding bearings (3);

(b) at least one heat exchanger (4) introduced from above into said tank, heatable with thermal oil, having substantially vertical heat exchange surfaces, and controlled by a temperature sensor;

(c) at least one submersible pump (5), introduced from above into said tank, to which is connected a flushing line (6) and a product line (7) for filling and emptying the tank;

(d) a pendant flexible gas line (8) adapted for connection to the tank;

(e) an inert gas line (9) connected to said tank, and for injecting inert gas into said tank and being adapted for control by a pressure switch;

(f) at least one safety valve (10, 11) connected to said inert gas line and having an overpressure outlet and an underpressure outlet, with a flametrap (12) at the overpressure outlet and an inert gas supply connection at the underpressure outlet;

(g) a non-mechanical liquid meter (13) adapted for use in said holding tank and a safety system that triggers an alarm at a filling level of 96 to 98%;

(h) a companion heating system for all the product and gas lines, including control and shutoff devices connected therewith; and (i) a heated, insulated manhole (14) on said holding tank.

2. The double hull ship according to claim 1, wherein said tank is attached at its lowermost point to the ship's hull.

3. The double hull ship according to claim 1, wherein a plurality of tanks are present.

4. The double hull ship according to claim 1, wherein ballast tanks (17) are installed between the inner and outer hull of said double hull.

5. The double hull ship according to claim 3, wherein transverse bulkheads (22) are located between adjacent tanks (1).

6. The double hull ship according to claim 1, wherein the sliding bearings on the tank consists of lignum vitae and are provided with spring elements for lateral movement.

7. The double hull ship according to claim 5, wherein pneumatic or hydraulic dampers (15) with gas springs are installed between a transverse bulkhead (22) and the neighboring tank wall.

8. The double hull ship according to claim 1, wherein the tank bottom has a slope of 3° to 5° from the horizontal.

9. The double hull ship according to claim 1, wherein a heatable sump is installed at the lowest point.

10. The double hull ship according to claim 1, wherein the tank insulation consists of inorganic material and is so dimensioned that the average temperature drop in the tank at a mean temperature of 250° C. is not more than 10° K/day.

11. The double hull ship according to claim 1, wherein all tank connections are connected to the deck of said ship by means of thin walled corrugated tubes and the lines are provided with expansion joints.

12. The double hull ship according to claim 5, wherein said transverse bulkhead and inner hull form compartments provided with means for access and are further provided with a temperature sensor and a fire-fighting means.

* * * * *